United States Patent [19]

Payton et al.

[11] Patent Number: 4,777,674

[45] Date of Patent: Oct. 18, 1988

[54] WHIRLPOOL BATH SUPPORT

[75] Inventors: Hugh W. Payton, 416 Jupiter St., Washington Court House, Ohio 43160; Steven E. Easter, Washington Court House, Ohio

[73] Assignee: Hugh W. Payton, Washington Court House, Ohio

[21] Appl. No.: 502,440

[22] Filed: Jun. 9, 1983

[51] Int. Cl.[4] ..... A47K 3/022

[52] U.S. Cl. ..... 4/578; 5/89; 297/457

[58] Field of Search ..... 4/559, 560, 571, 573, 4/578, 579, 590, 565; 128/65, 66, 370; 5/81 R, 89, 122; 297/441, 457

[56] References Cited

U.S. PATENT DOCUMENTS

| | | | |
|---|---|---|---|
| 22,733 | 1/1859 | Karshner . | |
| 732,249 | 6/1903 | Wolpert . | |
| 1,369,638 | 2/1921 | Edmonds et al. | 4/573 |
| 2,691,410 | 12/1954 | Boucher | 297/457 X |
| 3,195,954 | 7/1965 | Moreno | 297/441 |
| 3,234,568 | 2/1966 | Fischer | 5/89 |
| 3,595,224 | 7/1971 | Walter | 4/573 X |
| 4,192,024 | 3/1980 | Zigmont . | |
| 4,380,208 | 4/1983 | Goserud | 5/122 X |

*Primary Examiner*—Charles E. Phillips

*Attorney, Agent, or Firm*—Biebel, French & Nauman

[57] ABSTRACT

A sling arrangement is disclosed for supporting a patient in a relaxed position in the tank of a hydrotherapeutic or whirlpool bath to eliminate the need for the patient to hang onto the sides of the tank. A mesh body supporting hammock is formed of a generally rectangular shape, with the corners extended somewhat to form reinforced pockets. Front and rear stirrup pairs include supporting loops which are received within the pockets, the stirrup pairs being slidably mounted along the rim of the tank, including a forward stirrup pair which supports the forward edge of the hammock below the rim of the tank and a rearward stirrup pair which supports the back of the hammock in an elevated or somewhat upright position above the rim of the tank, so that the patient may be received in the hammock in a relaxed or semi-reclined position. The hammock also includes provision for supporting the neck and head region of the patient, permitting these muscles to be relaxed as well.

4 Claims, 2 Drawing Sheets

WHIRLPOOL BATH SUPPORT

BACKGROUND OF THE INVENTION

This invention relates to whirlpool therapeutic baths and more particularly to a sling or hammock body support arrangement for such a bath, for receiving and supporting a patient within the tub.

The typical whirlpool bath or tank now commonly in use for treatment of the lower back, hip, and lower extremities includes a stainless steel tank with reasonably straight side walls and a flat bottom. Such tanks have come into common use by physio-therapists and allied medical and surgical disciplines for beneficial treatment of the pain from strains, sprains, fractures, bursitis, myalgias, neuralgias, and in the care of burns. The value of controlled heat, particularly wet heat combined for a forceful movement of water against the areas described is recognized as beneficial to the healing process.

In order for a patient to receive these benefits, the person must sit in the flat bottom tub with its perpendicular side walls, in whatever position he or she can find in order to maintain a sitting posture. Even for a healthy person this presents the problem of hanging onto the sides of the tub while sitting down on a bottom surface with knees in flexion and with the heels attempting to find a comfortable position against the floor.

A number of prior patents have issued showing various arrangements of slings, hammocks, body supports or the like for supporting a patient within a tub of water. For example, Walter, U.S. Pat. No. 3,595,224 issued July 27, 1971 is particularly directed to the problem of supporting a patient in a hydrotherapy tank with an apparatus which supports a mesh hammock from the tank rim. While the position of the patient is not shown or described in Walter, it appears from the drawings that the patient might recline or perhaps sit on the hammock with the legs extended over the hammock sides and into the water. However, the Walter structure does not provide for support of the back, neck or head of the patient, and specifically does not provide for support of any portion of the hammock structure above the level of the tank rim.

A simple bathtub sling supported by hooks on the bathtub rim is shown in Wolpert et al, U.S. Pat. No. 732,249 issued June 30, 1903, while the more recent patent of Zigmont, U.S. Pat. No. 4,192,024 issued Mar. 11, 1980, shows a full length hammock for supporting a person in reclined position within a hot tub. Again, neither Wolpert et al or Zigmont provide for any support of the body above the level of the rim of the tank.

As a matter of interest, reference is also made to mesh or sling devices for supporting patients in reclined positions within "electric" baths, including Karshner, U.S. Pat. No. 22,733 issued Jan. 25, 1859 and House, U.S. Pat. No. 34,425 issued Feb. 18, 1862.

SUMMARY OF THE INVENTION

The arrangement of the present invention is a new approach to the problem of supporting a patient in a hydrotherapy or whirlpool tank, and includes two pairs of removable stirrups or braces adapted to be mounted on the perpendicular side walls of a tank, namely, a forward pair of stirrups and a rearward pair of stirrups. Each of the stirrup pairs is provided with a hammock support attachment, and in the preferred embodiment of the invention the attachment comprises an upstanding loop of stainless steel rod for enqagement within a pocket formed on a mesh wing-shaped hammock or sling. Each of the stirrups may be independently movable or adjustable along the rim of the tank with the rearward pair providing a hammock support which is positioned substantially above the level of the rim of the tank, while the forward pair support the hammock at a somewhat lower position below the tank rim. Preferably, the stirrups are coated with a rubber or polymer material which aids in gripping the rim of the tank and prevents unwanted shifting of the stirrups when weight is applied.

The invention further includes a mesh hammock formed with pockets or the like at the four corners thereof, adapted to be received over the respective front and rear pairs of stirrups, for supporting a patient in a sitting position within the tub, suspended just above the floor of the tub. The rear supports elevate and hold one end of the hammock substantially above the level of the rim, to support the back and neck, while the forward supports hold the forward end of the hammock in a braced position in the tub so that the legs may extend off the forward edge of the hammock and into the tub in a relaxed condition with the bottom elevated above the floor of the tub. The hammock may also have a portion which will particularly support the neck and head of the patient so that these body parts may relax and thereby obtain the greater benefit from the treatment. Since the remainder of the body will be comfortably relaxing in the hammock, the muscles previously used to hang onto the sides of the tub, and the back muscles used to support a patient in an upright sitting position, may now all be relaxed. This includes the relaxation of the hamstring and gluteal musculature. The position of the stirrup supports may be adjusted along the rolled upper edge of the tub, for accommodating variations in the size of the patient or the size of the particular sling which is being used.

It is accordingly an important object of the invention to provide a hammock arrangement for a therapeutic tub in which the patient may sit in the tub in a comfortable position, with a portion of a mesh sling supported above the rim of the tank, for supporting the patient's body off of the floor of the tank, and where desired, for further supporting the patient's neck and head to the end that the patient may more fully relax the muscles of his body and thereby obtain a greater benefit from the therapy.

Another object of the present invention is to provide a hammock and hammock-support arrangement for a therapeutic tank which is of low cost and is easy to use.

A still further object of the invention is the provision of a hammock and hammock support for a therapeutic tank in which a portion of the hammock is supported above the rim of the tank, to provide support for the buttocks and back of the patient sitting in the tank, so that the patient may be fully relaxed while receiving treatment.

These and other objects and advantages of the invention will be apparent from the following description, the accompanying drawings, and the appended claims.

DESCRIPTION OF THE PREFERRED EMBODIMENT

Figure 1:
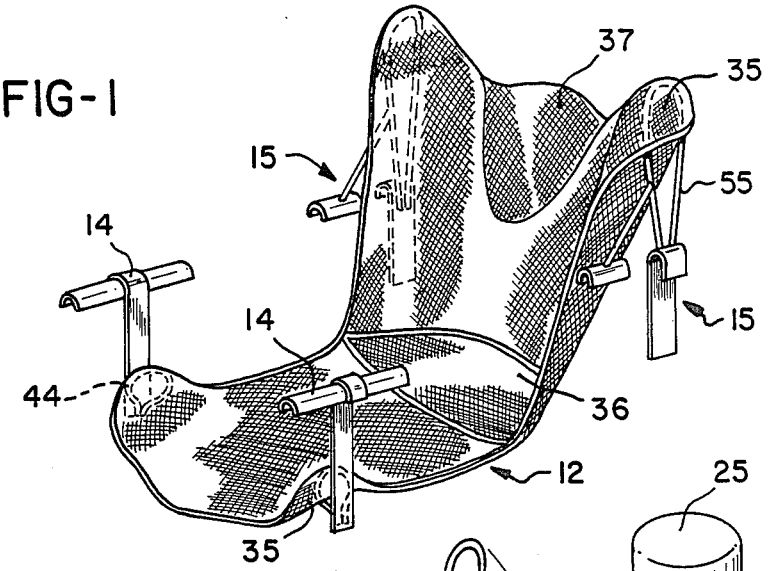
FIG. 1 is a perspective view of a hammock and stirrup arrangement of the invention.
Figure 2:
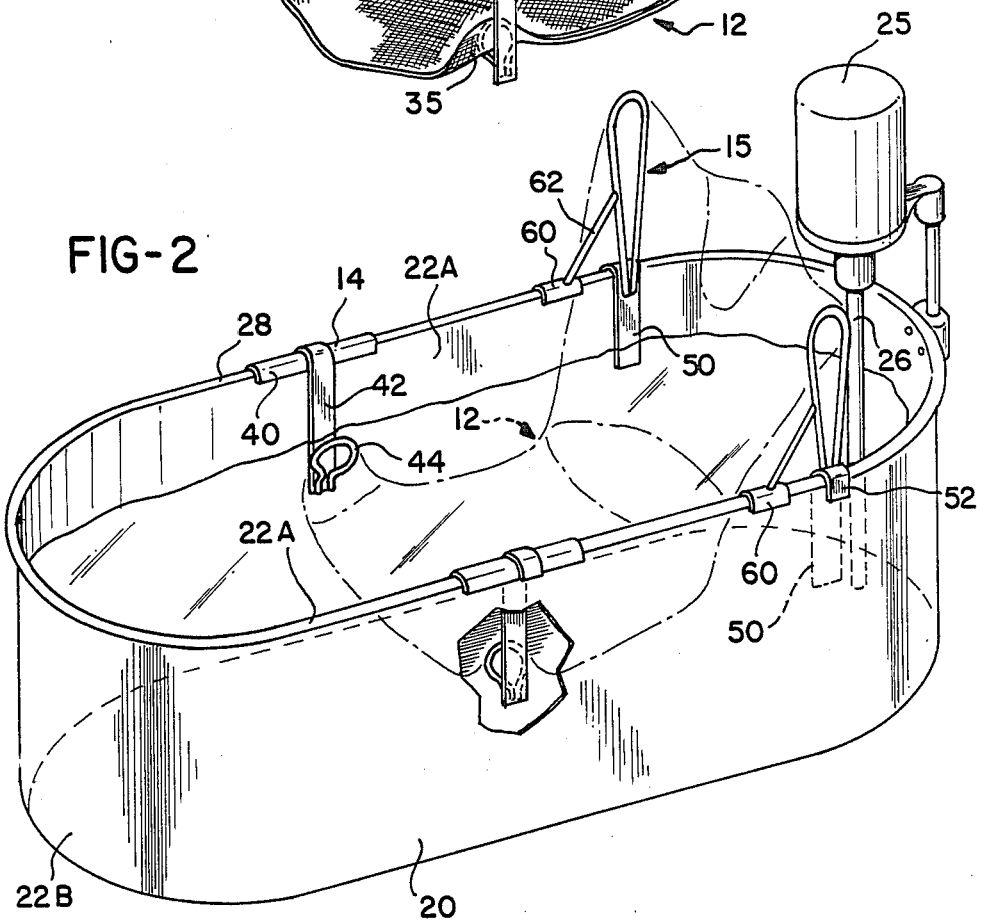
FIG. 2 shows the arrangement of FIG. 1 as applied to a therapeutic tank.

Referring to the figures of the drawings which ilustrate a preferred embodiment of the invention, a hammock and stirrup arrangement particularly adapted for supporting a mesh-type hammock in a hydrotherapeutic tank is illustrated generally at 10 in FIG. 1 as including a woven open-mesh hammock 12, a pair of forward stirrup supports 14 and a pair of rear stirrup supports 15. A typical therapeutic tank 20 as illustrated in FIG. 2 has generally perpendicular side walls 22 and a relatively flat bottom or floor 23. The tank further is provided with the customary permanently mounted drive motor 25 which pumps water down a vertical tube 26. The water is expelled through water apertures in the form of jets into the interior of the tank. The side walls 22 are usually formed in a continuous manner, with straight side sections **22*a* and curved ends 22*b*, and are provided with a rolled top edge 28**.

Figure 4:
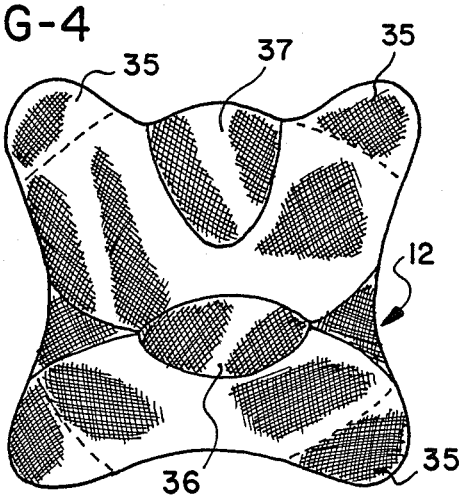
FIG. 4 is a plan view of the hammock portion of the invention.

The hammock 12 is of the sling type, and is adapted to be supported at its four corners. It is illustrated in FIG. 4 as defining generally a modified rectangular shape with wing-like extensions at the four corners. The corners are formed of a double layer of material providing cups or pockets 35. The pockets are sewn and reinforced along the margins, thereby forming recesses to receive a part of the supporting stirrups. The hammock 12 is proportioned to be received between the side walls **22*a* of the tank 20, and may be formed with a slightly indented central seat portion 36, and a somewhat rearwardly sloping head and neck portion 37. Preferably the hammock is formed of an open mesh material so as not to impede the flow of water therethrough, but must be sufficiently strong to support the weight of a person thereon, suspended within the tank. An open mesh fabric, which would normally have less strength against deformation when compared to ordinary hammock canvas, may be used since a substantial part of the patient's weight will be supported by the water within the tank. In the manufacture of the hammock 12, an open-mesh material bound about the margins or edges may be used, and in order to provide sufficient body conformity, the seat portion 36 and the neck portion 37 may be formed as insets which are joined with the remaining pieces making up the front and back of the hammock. Alternatively, the hammock may be made of one single piece of mesh material which will naturally conform to the body of the user, with the exception, of course, of separate pieces making up the four reinforced pockets 35**. The invention is not limited to this use of a hammock with corner pockets, and other attaching means may be employed, such as straps or the like.

Figure 5:
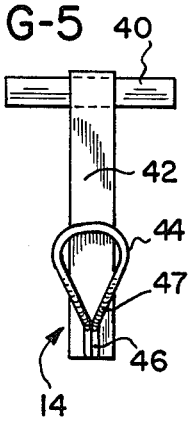
FIG. 5 is a front elevation of one of the forward stirrup supports.
Figure 6:
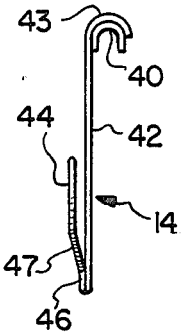
FIG. 6 is a side elevation of the support of FIG. 5.

The wing-shaped hammock 12 is supported partially within the tank 10 and partially above the tank 10 on a system of four stirrup supports consisting of the forward stirrup supports 14 and the rear stirrup supports 15. The forward stirrup supports are identical and therefore reversible. They are provided with a longitudinally extending, rim engaging partial sleeve 40, proportioned to be received over the rim 28 of the tub, as shown in FIG. 2. The sleeves 40 may be readily moved along the straight sections of the rim for convenient positioning, and have a length of about six inches to provide stability to the support. A depending hanger strap 42 has an upper portion 43 curved over the sleeve and welded thereto, and extends downwardly partially into the interior of the tank with an inside surface received against the adjacent inside surface of tank wall 22. An upstanding loop-shaped stirrup 44 is formed as an open loop of heavy gauge rod material. The stirrup 44 has terminal ends 46 brought together parallel to each other and welded together and to the lower terminal end of the hanger strap 42. The stirrup 44, above the ends 46, is offset transversely inwardly at 47 into the interior of the tank and then extends upwardly to form the closed loop, as shown in FIGS. 5 and 6. The slight offset assures clearance between the side walls of the tank and pockets 35 of the hammock when they are looped over the stirrup 44.

Figure 3:
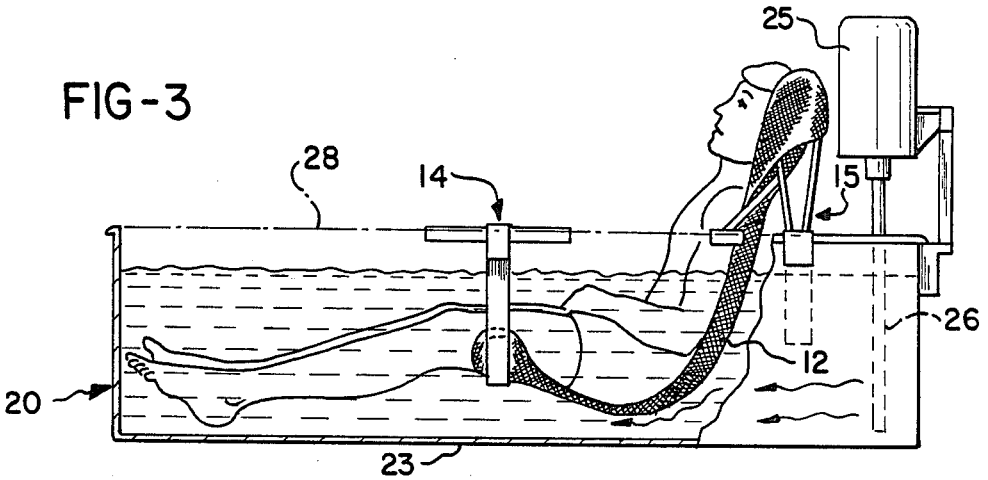
FIG. 3 is a side elevational view of the apparatus of FIG. 2.
Figure 7:
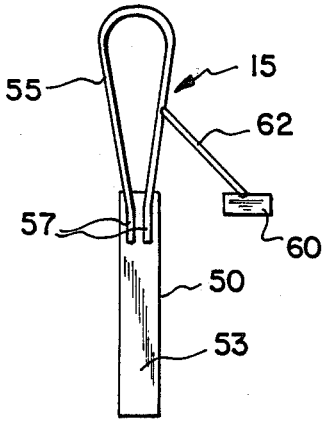
FIG. 7 is a front elevation of one of the rear stirrup and supports.
Figure 8:
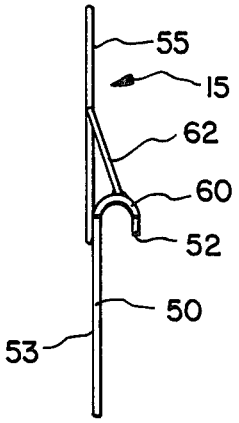
FIG. 8 is a side elevation of the stirrup of FIG. 7.

The stirrup support arrangement further includes left and right rear stirrup supports 15, as shown in FIGS. 7 and 8. The rear supports 15 include a hanger bracket 50 which has an upuper curved end 52 adapted to be received over the tank rim 28, with a depending stabilizing strap portion 53 adapted to be received against the inside tank surface. The bracket 50 supports an upwardly extending loop-shaped stirrups 55 also formed of rod material. The stirrups 55 have bottom terminal ends 57 which are suitably secured, such as by welding, to the inside upper surface of the bracket 50, and which form an upwardly extending closed loop which, in use, extend substantially above the plane of the rim 28 of te tank, as best shown in FIGS. 2 and 3. Lateral support is provided by a small inverted U-shaped rim engaging trough section 60 connected by a rigid rod 62 to the loop, and positioned forwardly of the bracket 50 within the tank, so that the rod 62 resists the forward bending force applied by the hammock to the upwardly extending stirrups 55, when the weight of a patient is carried on the hammock. Again, the supports 15 may be positioned along the side walls of the tank by sliding, so as to conveniently accommodate the hammock 12 with the pockets 35 received over the respective stirrups or loops of the support, and with a substantial portion of the hammock elevated at the region of the shoulders, neck and head of the patient above the rim of the tank.

The stirrup supports 14 and 15 may have non-slip coating applied thereto, especially where these parts engage the rim, to prevent unwanted slippage along the rim when weight is applied. A preferred arrangement is that of applying a rubber coating to the supports 14 and 15.

It will therefore be seen that the therapeutic hammock or seat arrangement of the present invention permits a patient to be seated within a hydrotherapeutic tub in a generally normal sitting and relaxed position with the buttocks spaced a few inches above the floor 23, with the legs extended forwardly of the hammock seat in a comfortable and relaxed position. The space formed at the bottom between the patient and the floor provides for flow and circulation of the water under, as well as around the patient, thus permitting beneficial effect of the water flow to reach the lower extremities, such as the legs and knees. The cup-like insert region 37 of the hammock provides an area in which the neck and head may be relaxed and received so that these body structures may be relaxed. Since the remainder of the body is comfortably relaxing in the hammock, the muscles which had previously been used to hang onto the sides of the tub, as well as the back muscles used in supporting the patient in an upright sitting position, may now all be relaxed. The suspension of the hammock off of the floor not only creates a more relaxed sitting position, but causes less flexion of the knees, with relaxation of the hamstring and gluteal muscles.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A sling arrangement for supporting a patient in a relaxed sitting position in the tank of a hydrotherapeutic bath, comprising:

a first pair of generally upstanding stirrup supports, each of said stirrup supports having means integral therewith for attachment to the rim of such tank, and further having a downwardly extending stabilizing strap portion for engagement with an inside surface of such tank, and each having a generally upwardly directed hammock-receiving loop extending, when attached to the side wall of the tank, to a region above the plane of the tank rim, a second pair of stirrup supports, each including integral support means for attachment to the rim of the tank and being provided with a loop-supporting strap extending downwardly adjacent the inside surface of the tank walls and terminating in an upwardly extending hammock-receiving loop, the upper extremity of which is positioned below the plane of the tank rim, and a mesh body support hammock of generally rectangular shape, means at each of the four corners defining pockets proportioned to be received over one each of said stirrup loops with a seat portion of said hammock extending into the interior of said tank but spaced from the bottom thereof for supporting the torso of a person thereon with the person's legs extending outwardly into said tank from said hammock, and a back portion thereof extending upwardly above the rim of the tank.

2. The sling arrangement of claim 1 in which said hammock is formed with an inset positioned to provide support to the head and neck regions.

3. The sling arrangement of claim 1 in which said loops are formed of rod material.

4. A sling arrangement for supporting a patient in a relaxed sitting position in the tank of a hydrotherapeutic bath, comprising:

a first pair of supports, each of said supports having means integral therewith for attachment to the rim of such tank, and each having a hammock supporting extension extending, when attached to the side wall of the tank, to a region substantially above the plane of the tank rim, a second pair of supports, each including means for attachment to the rim of the tank and being provided with a hammock-receiving and supporting extension positioned adjacent the inside surface of the tank walls and extending to a region substantially below the tank rim, and a body support hammock and having means formed at each of four corners defining pockets proportioned to receive one each of said supporting extensions with a bottom portion of said hammock extending into the interior of said tank but spaced from the bottom thereof for supporting the torso of a person thereon with the person's legs extending outwardly into said tank from said hammock, and back portion thereof extending upwardly above the rim of the tank.

* * * * *